US005573453A

United States Patent [19]

Tiefenbach, Jr.

[11] Patent Number: 5,573,453

[45] Date of Patent: Nov. 12, 1996

[54] FIBER REINFORCED ABRASIVE MOLD AND DIE FINISHING TOOLS

[75] Inventor: Lawrence W. Tiefenbach, Jr., Traverse City, Mich.

[73] Assignee: B.O.T.S.G., Inc., Traverse City, Mich.

[21] Appl. No.: 517,449

[22] Filed: Aug. 21, 1995

[51] Int. Cl.[6] ..... B24D 11/00

[52] U.S. Cl. ..... 451/533; 451/534

[58] Field of Search ..... 451/533, 168, 451/536, 534, 526, 546, 544; 51/297, 298; 428/34.6, 34.7, 36.2, 408, 294, 904

[56] References Cited

U.S. PATENT DOCUMENTS

| | | | |
|---|---|---|---|
| 2,069,116 | 1/1937 | Sanford . | |
| 2,375,263 | 5/1945 | Upper | 51/297 |
| 2,405,524 | 8/1946 | Sharpe | 451/532 |
| 2,804,733 | 9/1957 | Hurst . | |
| 3,540,163 | 11/1970 | Shoemaker . | |
| 3,685,215 | 8/1972 | Bates . | |
| 3,716,950 | 2/1973 | McClure . | |
| 3,838,543 | 10/1974 | Lakhani . | |
| 3,867,795 | 2/1975 | Howard . | |
| 4,218,851 | 8/1980 | Rue . | |
| 4,259,089 | 3/1981 | Waizer et al. . | |
| 4,949,511 | 8/1990 | Endo et al. . | |
| 5,085,928 | 2/1992 | Krueger | 428/294 |
| 5,116,668 | 5/1992 | Yamamoto | 428/294 |
| 5,233,794 | 8/1993 | Kikutani et al. | 451/546 |
| 5,249,566 | 10/1993 | Sawluk . | |
| 5,344,589 | 9/1994 | Ide et al. | 428/294 |

OTHER PUBLICATIONS

Congress Polishing Stones, Product Bulletin, 1991.

Supra Stones (Flat), Product Bulletin, 1991.

Federation of European Producers of Abrasive Products (Standard A2–GB–1984).

Fiberite, Product Bulletin, 1995.

Tool and Manufacturing Engineers Handbook, Ed. W. H. Cubberly et al. Chapter 16, Advanced Composites, 1989, pp. 16–12 through 16–13.

*Primary Examiner*—D. S. Meislin

*Assistant Examiner*—George Nguyen

*Attorney, Agent, or Firm*—Reising, Ethington, Barnard & Perry

[57] ABSTRACT

Described is a fiber reinforced abrasive polishing and finishing tool comprising:

a multi layer laminate comprised of a first abrasive layer and a second abrasive layer, and a layer of B-staged adhesive resin matrix containing fiber reinforcing material, e.g. graphite between the abrasive layers wherein all of the layers are secured together at least in part by the adhesive resin.

Also described is a method of manufacturing the tool by applying heat and pressure to a laminate of the adhesive and abrasive layers with the adhesive layer therebetween.

9 Claims, 1 Drawing Sheet

FIBER REINFORCED ABRASIVE MOLD AND DIE FINISHING TOOLS

TECHNICAL FIELD

This invention pertains to fiber reinforced abrasive mold and die polishing and finishing tools.

BACKGROUND OF THE INVENTION

Various steel, aluminum and other metal molds or dies are produced for the plastic, injection molding and die casting industries. These molds or dies often contain difficult to reach areas like thin slots or ribs that need to have a finish like the other larger, more reachable surfaces. To do this, the mold maker or polisher will often take a larger abrasive stone (e.g., a 1/16×1/4×6 in) and form a thin point on the end of it. This tool works well to remove the scratches and EDM deposits in the rib but the ground tip is extremely fragile and will snap off easily. Thus the polisher has to stop and reform a new tip. Mold makers use numerous other tools to accomplish this difficult polishing task. Some of these are thin diamond files, thin brass tools with lapping compound, emery paper and various homemade tools. All of these have major disadvantages.

A product designed for hard to reach finishing, e.g., slot and rib finishing or polishing is being sold under the name Supra Ceramic Stone. It is a thin (1 mm×4 mm×100 mm and other sizes: 1 mm×6 mm×100 mm; 1 mm ×10 mm×100 mm, and the like), fiber product. It is described as a composite material consisting of long ceramic fibers and a thermosetting resin. It contains none of the "abrasive grit" or porosity that is found in a traditional abrasive stone. The way this specialized ceramic fiber is fabricated gives it abrasiveness to polish these difficult ribs and slots. Ordinary epoxy bonded glass fibers (fiber reinforced plastics, FRP) albeit strong, do not cut. The "Supra" stone's advantage over an ordinary mold stone is its strength and rigidity for such a thin part while having the ability to abrade metals. A 1 mm×4 mm×100 mm abrasive mold and die polishing stone would snap like chalk under similar conditions. Disadvantages of the Supra Stone are (1) it does not cut quite as well as a resin or vitrified bonded abrasive stick and (2) the raw materials price is very high.

U.S. Pat. No. 5,233,794, assigned to Nippon Steel Corporation, describes a rotary tool for cutting, drilling, grinding or polishing metallic or non-metallic materials. It is made of a compact material which consists of inorganic fiber reinforced plastic containing 50–81 vol. % of inorganic long fibers. The remaining portion of the compact material consists of a thermo-setting resin matrix. The Supra Stone material described above may be described in this patent.

U.S. Pat. No. 3,867,795, assigned to Norton Company, describes a reinforced resin bonded abrasive depressed and straight center wheels for portable snagging grinders. It is described as having a primary abrading portion extending along the bottom side to the peripheral grinding face occupying a portion of a pre-determined thickness of the wheel and having resin bonded primary abrasive particles of alumina-zirconia therein. It also has a secondary abrading portion bonded to and extending from the primary abrading portion to the top side and peripheral grinding face of the wheel and has resin bonded secondary abrasive particles of a secondary abrasive material which differs from and of less durability than alumina-zirconia abrasive material.

U.S. Pat. No. 4,218,851, assigned to Norton Company, describes a high speed rotatable abrasive body which is a resin bonded abrasive body. Described is an abrasive body which has an elongated rectangular shape similar to a center part or a circular grinding wheel from which two identical diametrically opposed arcuate segments have been removed. The abrasive body has a central portion with diametrically opposite arcuate spindle flange mounting segments with tapered surfaces projecting from opposite edges of diametrically opposite grinding portions extending substantially at right angles therefrom to diametrically opposite peripheral grinding surfaces. Situated within and axially spaced between opposite parallel sides 24 of the abrasive body are a number of layers of reinforcing material 26.

Other patents of interest are U.S. Pat. Nos. 5,249,566; 3,716,950; 2,804,733; 3,684,215; and 4,259,089.

None of the references or the prior art describes a mold and die polishing and finishing tool having multiple layers of abrading surface held in position with longitudinally placed unidirectional graphite fibers which are present in an adhesive resin bonding matrix which secures the layers together.

It is an object of the present invention to have a mold and die polishing and finishing tool having top and bottom abrasive layers with an adhesive resin bonding matrix containing graphite fiber layer between which secures the layers together.

SUMMARY OF THE INVENTION

Described is a fiber reinforced abrasive polishing and finishing tool comprising a multi layer laminate comprised of a first abrasive layer and a second abrasive layer, and a layer of adhesive resin matrix containing fiber reinforcing material, such as graphite, between the abrasive layers wherein all of the layers are secured together at least in part by the adhesive resin.

Also described is a method of manufacturing the tool as described above comprising the steps of:

(a) providing at least a pair of thin fragile abrasive layers;

(b) providing a flexible adhesive resin matrix containing fiber layer, such as graphite;

(c) placing the adhesive resin matrix layer between the abrasive layers;

(d) applying heat and pressure to the layers simultaneously whereby the adhesive resin softens and secures the layers by passing, at least in part, into the abrasive layers; and (f) recovering a thin polishing tool laminate having a flexural strength exceeding the individual layers, as initially provided, by a factor of at least 3.5 times the strength of the individual layers. Alternatively, the factor can be at least 10 times.

DESCRIPTION OF PREFERRED EMBODIMENT

Figure 1:
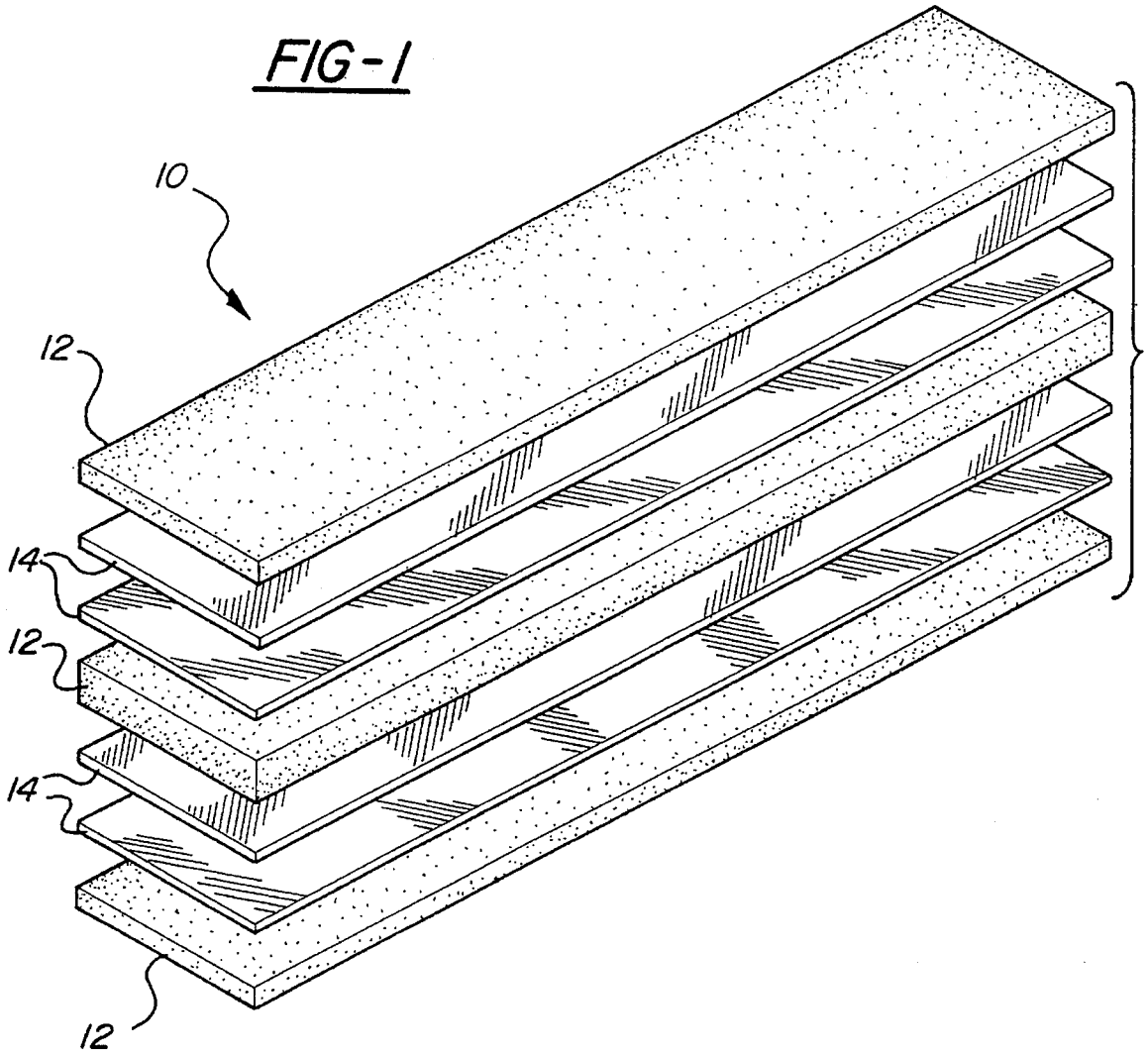
FIG. 1 is an exploded perspective view of the fiber reinforced abrasive mold polishing tool of the present invention.

The mold and die polishing or finishing tool of the present invention may be prepared from a variety of sources of the abrasive materials and the fiber reinforced adhesive material, e.g., a prepreg. By "prepreg" is meant a resin matrix containing fibers therein. In other words it is reinforcing fibers which are pre-impregnated with a resin system, preferably cured to the "B-stage" and ready for assembly and molding. See "Engineer's Guide to Composite Materials", American Society for Metals, 1987 pgs. 6–22 and 14–15. These materials are generally commercially available in the marketplace. A technique for preparing the abrasive wafers of the present invention is as follows.

The abrasive wafers are first fabricated by slicing larger abrasive blocks (1×4×6 in or 1×6×8 in) with cutting machines employing diamond cutoff wheels. The dimensions of these wafers are 0.035×2.0×8.0 inch. Tolerances are held at ± 0.010 in. on the thickness over the entire length and ± 0.005 in. on the thickness over the entire width. The wafers are next ground. Tolerances are held at ± 0.0005 over the entire thickness. The final dimensions are 0.020×2×8 and 0.017×2×8. The tolerances on length and width can vary as they have little effect on the performance of the product, but larger variation can effect yield and as such needs to be reasonably controlled. There are several ways to cut thin wafers including but not limited to diamond wire cutting, laser cutting, and abrasive water jet cutting.

The preferred composition for the abrasive blocks for wafers is resin bond. The preferred abrasive grit is either aluminum oxide or silicon carbide. Abrasive grit sizes can be one or mixtures of any of the standard FEPA (Federation of European Producers of Abrasive Products standard 42-GB-1984) grit sizes, preferably 220 and 320 sizes (53 and 29 microns respectively). A large number of combinations of pore, grit, and bond volume abrasive formulations can be produced as the abrasive material. This allows for custom engineering of the abrasive for the particular cutting/polishing application. The ability to engineer a particular abrasive formulation is an advantage over the patented article of U.S. Pat. No. 5,233,794. Thus, custom properties for the invention are possible as wafers are cut from this engineered abrasive block.

The abrasive blocks can be made from other types of abrasives which can include but are not limited to cubic boron nitride (CBN), diamond, metal carbides, silica, emery, or virtually any hard material that can be suitably bonded with a resin bond.

In addition, this invention is not limited to cutting thin wafers from larger blocks but could include manufacturing thin abrasive wafers or films to size. Tape casting technology is available to produce thin ceramic substrates for the electronic industry. Therefore abrasive formulations could be produced via this technology.

The invention employs a unidirectional prepreg tape (HYE 3477-2H, Trademark of ICI Fiberite) for carbon fiber reinforced unidirectional tape. The preferred fiber type is a M60J graphite fiber. This fiber has a flexural modulus of 85 MSI (1×106 psi) which gives the product the necessary rigidity with the minimum prepreg tape thickness. The prepreg tape contains an epoxy resin that is B-staged. The preferred epoxy is 977-2, also from ICI Fiberite. It has a flexural modulus of 0.50 MSI. Prepregs of similar composition produce parts having a tensile modulus of 24 MSI and a tensile strength of 390 Ksi. Minimizing the prepreg thickness is desirable as this reinforcement layer can inhibit the cutting action of the tool. The purpose of the fiber reinforcement is to strengthen and stiffen the otherwise fragile abrasive wafers. It may help lubricate as it abrades away during use but it does not otherwise help with cutting. It has been found that a prepreg tape 0.002 inch thick is sufficient to strengthen and stiffen the article when laminated with the thin abrasive wafers. The prepreg has sufficient epoxy so that during the pressing cycle the epoxy will soften and penetrate the abrasive wafer approximately 0.002 in. The preferred formulation is a prepreg tape having a fiber area weight of 61.1±3.5 (gm/M$^2$) and a resin content of 43±2 weight percent.

Other fiber reinforcement could be utilized. Examples include but are not limited to glass fiber or paper or rope or roving; ceramics like $Al_2O_3$ fibers, mullite, silicon nitride fibers, SiC fibers; organics like polyester, Kevlar (trademark of DuPont for polyamide fiber), boron fibers, and nylon, and the like.

Additionally the epoxy bonding system is not the only resin system that will work. Other thermoplastic or thermoset resin systems may be used such as phenolics, vinyl esters, bismaleimide polyamides, polyimides urethanes, polysulfone, silicones, polyphenylene sulfide, polyether etherketone, cyanoacrylates, contact cements and the like.

The prepreg tape is unidirectional. This gives the part its greater strength along the length where reinforcement is necessary. Bi-directional prepreg fabrics may be used but may be too thick and do not bond as well to the rough surface of the abrasive wafer. The added strength that could possibly develop along the parts width may not be necessary. Also the fibers running perpendicular to the long axis may inhibit cutting.

The tool product (10) is laminated together as shown in FIG. 1. The base layer (12) is a thin (0.010) abrasive wafer. This is followed by 2 prepreg tape layers (14) each at an alternating 10 degree bias (direction of fiber) with the long axis. The third layer (12) is another abrasive layer. FIG. 1 shows the middle layer (12) of a total of seven layers as a thicker (0.020 in.) abrasive wafer. The middle layer shown has two prepreg layers on each side of it. The orientation of the fibers were chosen to seek high stiffness and high strength along the parts length plus some torsional strength. Fiber orientation may be further optimized as desired for particular results.

The middle wafer is preferably thicker than the two outer ones. This is to maximize strength by placing the fiber reinforcement furthest away as possible to the centerline while still having an abrasive layer on the outside. The minimal desirable thickness of abrasive layer was found to be 0.010 in. This was the amount desired to give a sufficient "abrasive" leading edge for the cutting,and yet have a wafer that is "cuttable" on a production basis.

Also, one may leave the outer wafers thicker, say 0.017 in. and grind the pressed sandwich on both sides so that the outside wafers end up at 0.015 in. This way, it improves the appearance of the product.

It has been found that acceptable bonding occurs on those parts which have the highest density, the finest abrasive grit size, and the smoothest cut surface. In fact, the preferred product is the resin bonded abrasive because it has the lowest pore volume and the cut surface is extremely flat and smooth.

DETAILED PROCEDURE

Resin bonded abrasive blocks are cut into 0.035×2.0×8.0 inch wafers utilizing a diamond cutoff wheel on a surface grinder. Any method to obtain flat, smooth, and parallel wafers can be used. The wafers are carefully rinsed to remove loose cutting debris and cleaned in an ultrasonic cleaner for 60 min. at 50° C. A standard ultrasonic cleaning solution is used at ½ concentration. Resin bonded abrasive wafers are dried overnight at room temperature.

The tooling for this process consists of a 2×12×12 inch slab (bottom 20) and a ¼×12×12 inch slab (top) of a tool steel (22) that was blanchard ground flat and parallel to ± 0.0005 in. A pressure pad material (not shown) is applied to both inside surfaces. A non-silicone rubber like Airpad from Airtech International works well. The Airpad should be cured by heating to 350 F. while applying a pressure of 100 psi (7.2 tons of force) onto the tooling.

A 0.001 inch thick release film 24 is applied (A4000 clear, Airtech International) to the bottom steel punch containing the cured pressure pad material. The same is done to the top steel punch.

The laminate is prepared as follows: the 0.017 inch thick wafers (10) are placed onto the release film in a soldier style manner; 1 row (5 ea) of 2×8 inch wafers. To this, two layers of prepreg tape are laid. The first layer of tape is rotated such that the fiber direction is at a 10 degree angle with the centerline of the long axis of the wafer (8 inch length). Another layer of tape is applied in the same manner except the angle of rotation is 10 degrees opposite the first layer of prepreg tape. Next a layer of 0.020 inch wafers is placed onto the double layer of prepreg tape. A second double layer of prepreg tape is added exactly like the first prepreg layer. Another layer of thin wafers (0.017 inch) are positioned as previously described. Finally the top steel punch is laid on top with the release film side towards the wafers.

Figure 2:
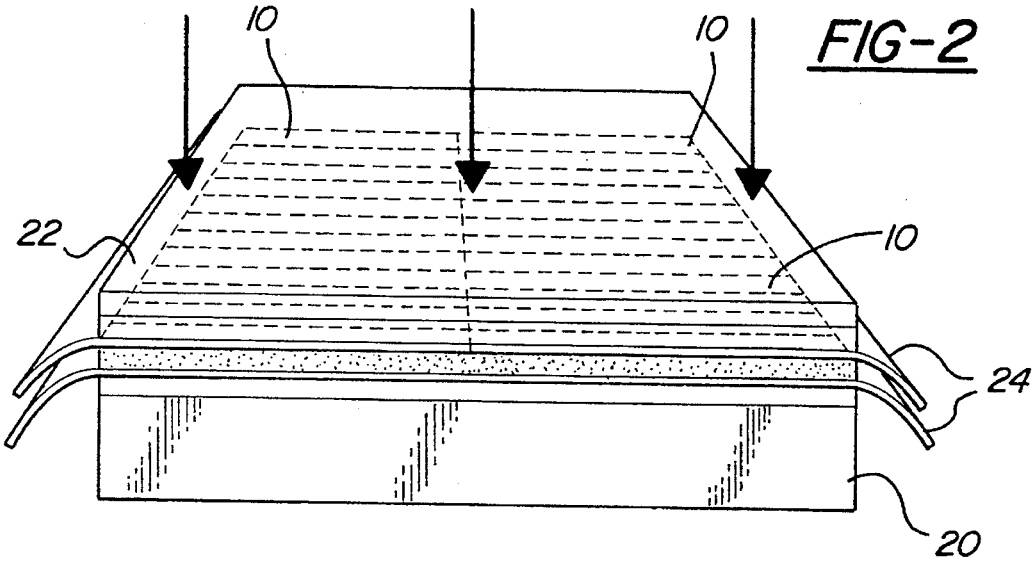
FIG. 2 is a schematic diagram of the heating and pressing operation utilized to manufacture the fiber reinforced abrasive mold polishing tool of the present invention.

The tooling is placed in a press that has heated platens. The platens (not shown) are first heated so they are at a 350° F. equilibrium. The tooling setup (20,24) is placed in the press and the platens brought to the point of touching but without applying a load. After approximately 10 minutes have passed or the temperature within the setup reaches 250° F., a 3 ton load is applied (demonstrated by the arrows in FIG. 2). As the tooling continues to heat to 350° F., the tonnage will increase because of thermal expansion. The load increases and is kept between 3–4 tons (about 100 psi) for a 2 hour duration. The pressure is released, the tooling removed and the parts (sheet) are stripped.

After the sheet has cooled to room temperature, parts of various lengths and widths can be cut from the 2×8 areas of the sheet. Cutting is performed using the same equipment used to cut the wafers. The outer edge of the 2×8 perimeter is removed because of imperfect stacking with the 3 wafer layers and/or excess epoxy that may have spilled on to the edge. Also, the "sheetlets" are ground to remove any excess resin and surface blemishes a total of 0.002 in. is removed from each side. The product offering in terms of sizes may vary such as 3, 4 and 6 inch lengths by ⅛, ¼ and ½ inch widths.

The preferred polishing tool of the present invention has at least two prepared layers between each of the abrasive layers. As shown in FIG. 1, the most preferred embodiment has a total of seven layers.

The preferred composition of the present invention is composed of prepreg tape having graphite fiber of 60–65 g/m$^2$ and a resin content 41–45 weight percent. The preferred fiber is graphite fiber (M60J) using resin for the prepreg. The preferred resin is 977-2 epoxy resin of the prepreg.

The preferred polishing tool of the present invention (finished tool) has an amount of abrasive layer at 80-92 vol. % and the remainder the fiber reinforcement layer.

The polishing tool of the present invention has a final flexural strength of at least 3.5 times the flexural strength of the unreinforced part, i.e., no fiber reinforcement, for the resin matrix according to ASTM D790-92 Method I, Procedure A. The abrasive layers can best be characterized as being thin, fragile layers. The prepreg layer is characterized as being flexible and readily bendable. After the application of heat and pressure, however, some resin from the resin matrix passes from the prepreg layer into the abrasive layers resulting in a fixed and firm fully bonded laminate. The resin matrix transfers applied loads to the unified fibers so that their stiffness and strength can be fully utilized in both tension and compression thereby inhibiting fracture of the fragile abrasive. While the forms of the invention herein disclosed constitute presently preferred embodiments, many others are possible. It is not intended herein to mention all the possible equivalent forms or ramifications of the invention. It is understood that the terms used herein are merely descriptive rather than limiting, and that various changes may be made without departing from the spirit or scope of the invention.

What is claimed is:

1. A fiber reinforced abrasive polishing and finishing tool comprising:

a multi layer laminate comprised of a first abrasive layer and a second abrasive layer, and a layer of adhesive resin matrix containing fiber reinforcing material between the abrasive layers wherein all of the layers are secured together at least in part by the adhesive resin matrix, wherein the tool is comprised of a thin polishing tool laminate having a flexural strength exceeding the individual layers, as initially provided, by a factor of at least 3.5 times the flexural strength of the individual layers.

2. The tool of claim 1 wherein the fiber is graphite and is prepared from a continuous unidirectional fiber tape.

3. The tool of claim 1, wherein the fiber has a length greater than 10× its width.

4. The tool of claim 1, wherein the resin matrix is a prepreg of resin with a unidirectional fiber therein.

5. The tool of claim 1, wherein the fibers are selected from the group consisting from graphite, glass, ceramic, polyester, Kevlar, boron and nylon.

6. The tool of claim 1 wherein the resin matrix has a resin adhesive selected from the group consisting of epoxies, phenolics, vinyl esters, bismaleimide, polyamides, polyimides, urethanes, polysulfone, silicones, polyphenylene sulfide, cyanoacrylates and contact cement.

7. A fiber reinforced abrasive polishing and finishing tool comprising a multi-layer laminate comprised of a first abrasive layer and a second abrasive; and a layer of B-staged adhesive resin matrix containing fiber reinforcing material between the abrasive layers, wherein the layer of reinforcing material is comprised of multiple layers with an additional abrasive material between the adhesive layers, wherein after curing, all of the layers are secured together at least in part by the adhesive resin matrix, wherein the tool is comprised of a thin polishing tool laminate having a flexural strength exceeding the individual layers, as initially provided, by a factor of at least 3.5 times the flexural strength of the individual layers.

8. The tool of claim 7 having seven layers comprising the following layers on top of each other in the order listed:

(a) an abrasive layer;

(b) an adhesive layer;

(c) an adhesive layer;

(d) an abrasive layer;

(e) an adhesive layer;

(f) an adhesive layer; and (g) an abrasive layer;

wherein the adhesive layer is a prepreg of resin matrix.

9. The tool of claim 8, wherein the prepreg contains unidirectional graphite fibers.

* * * * *